US006913800B2

(12) United States Patent
Monks

(10) Patent No.: US 6,913,800 B2
(45) Date of Patent: Jul. 5, 2005

(54) DECORATIVE AROMATIC PINE CONE DISPLAY ASSEMBLY

(76) Inventor: Rhonda L. Monks, 112 Bartley Ave., Butler, PA (US) 16001

( * ) Notice: Subject to any disclaimer, the term of this patent is extended or adjusted under 35 U.S.C. 154(b) by 0 days.

(21) Appl. No.: 10/264,520

(22) Filed: Oct. 4, 2002

(65) Prior Publication Data

US 2005/0031802 A1 Feb. 10, 2005

(51) Int. Cl.[7] ..... A01N 3/00
(52) U.S. Cl. ..... 428/22; 428/7; D11/121
(58) Field of Search ..... D11/121; 44/275; 425/803; 427/4; 428/7, 17, 22; 431/126; D26/6

(56) References Cited

U.S. PATENT DOCUMENTS 4,386,904 A * 6/1983 Miyahara et al. ..... 431/126
4,725,286 A * 2/1988 Brame ..... 44/533
5,702,781 A * 12/1997 Barker ..... 428/16
6,036,925 A * 3/2000 Adams et al. ..... 422/126

* cited by examiner

*Primary Examiner*—Deborah Jones
*Assistant Examiner*—Arden B. Sperty
(74) *Attorney, Agent, or Firm*—The Webb Law Firm

(57) ABSTRACT

A decorative pine cone display is provided with visually pleasing color and sensory appealing aroma by dissolving selected color dye and scented oil in hot liquefied beeswax utilized to form a coating on a specific pine cone assembly whereby warming of the coating promotes release of pleasant aroma in the general area of the display structure.

9 Claims, 3 Drawing Sheets

DECORATIVE AROMATIC PINE CONE DISPLAY ASSEMBLY

BACKGROUND OF THE INFORMATION

This invention pertains generally to festive decorative displays as generally used on holiday occasions, and pertains specifically to a pine cone display structure having predetermined characteristics which are aesthetically pleasing with regard to both appearance and smell.

There is a surprisingly strong continuous interest in holiday decorative display items. Such items, sold through flea markets and novelty stores, etc., have continuous popularity. Displays of Christmas wreaths and fragrant holiday candles are quite common, as are pine boughs and pine cones.

The present invention comprehends the use of pine cones for forming holiday displays which have an aromatic component which is activated by ambient temperature increase to provide a distinctive pleasant aroma whereby the display has both visual and sensory appeal.

SUMMARY OF THE INVENTION

In the preferred embodiments of the invention structure herein disclosed, a first major pine cone is used in combination with a second minor pine cone or bud. A commercially available concentrated fragrance is mixed with heated liquified beeswax to form a coating material for the major or first pine cone and the minor pine cone. The pine cones are dipped into the mixture at least once or a plurality of times to thoroughly coat their exterior. The beeswax coating, which may also be selectively colored by the addition of a suitable commercially available dye, transforms the pine cones into components for a colorful and aesthetically pleasing display object.

It is a natural characteristic of pine cones to have a central circular flat outer base portion where the pine cone stem has broken away. This central base area serves as a flat anchor point to which a relatively small bud-like pine cone may be firmly attached with its base against the central base of the larger cone. A firm connection between the cone bases may be formed by utilization of a glue gun to place a small glob of hot melted glue on the first pine cone base central point. An intermediate section of cord may be placed across the point of jointure before application of the smaller or minor cone to the major cone base whereupon the connection is completed. The cord is preferably a closed loop that will serve as a means of hanging the pine cone display on a hook or nail where desired as, for example, in a window frame such that the radiant heat of sunlight passing through the window glass will slightly soften the beeswax coating and thereby promote the release of the aromatic substance contained in the wax.

DETAILED DESCRIPTION OF THE PREFERRED EMBODIMENTS

Figure 1:
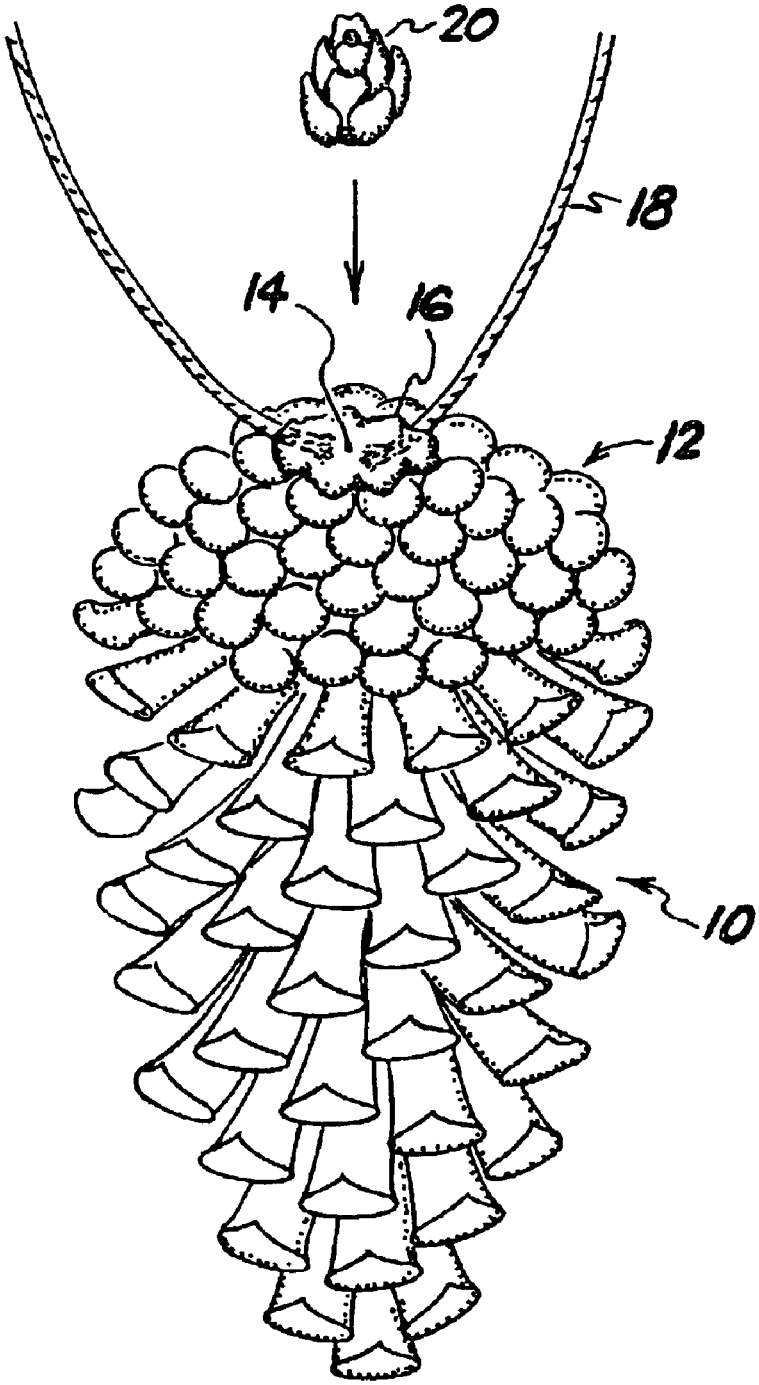
FIG. 1 is an elevational view of a first or major pine cone illustrating a step in the connection of a second or minor pine cone to its intended position on the base of the major pine cone.

FIG. 1 illustrates an assembly 10 comprising a first or major pine cone 12 having a central flat area 14 to accommodate the placing thereon of glue 16 for retaining a cord 18 at an intermediate point thereon and, further, for receiving and firmly holding the second or minor pine cone 20 in a position on the cone 12 such that pointed ends of the cones 12 and 20 face away from each other in axial alignment.

Figure 2:
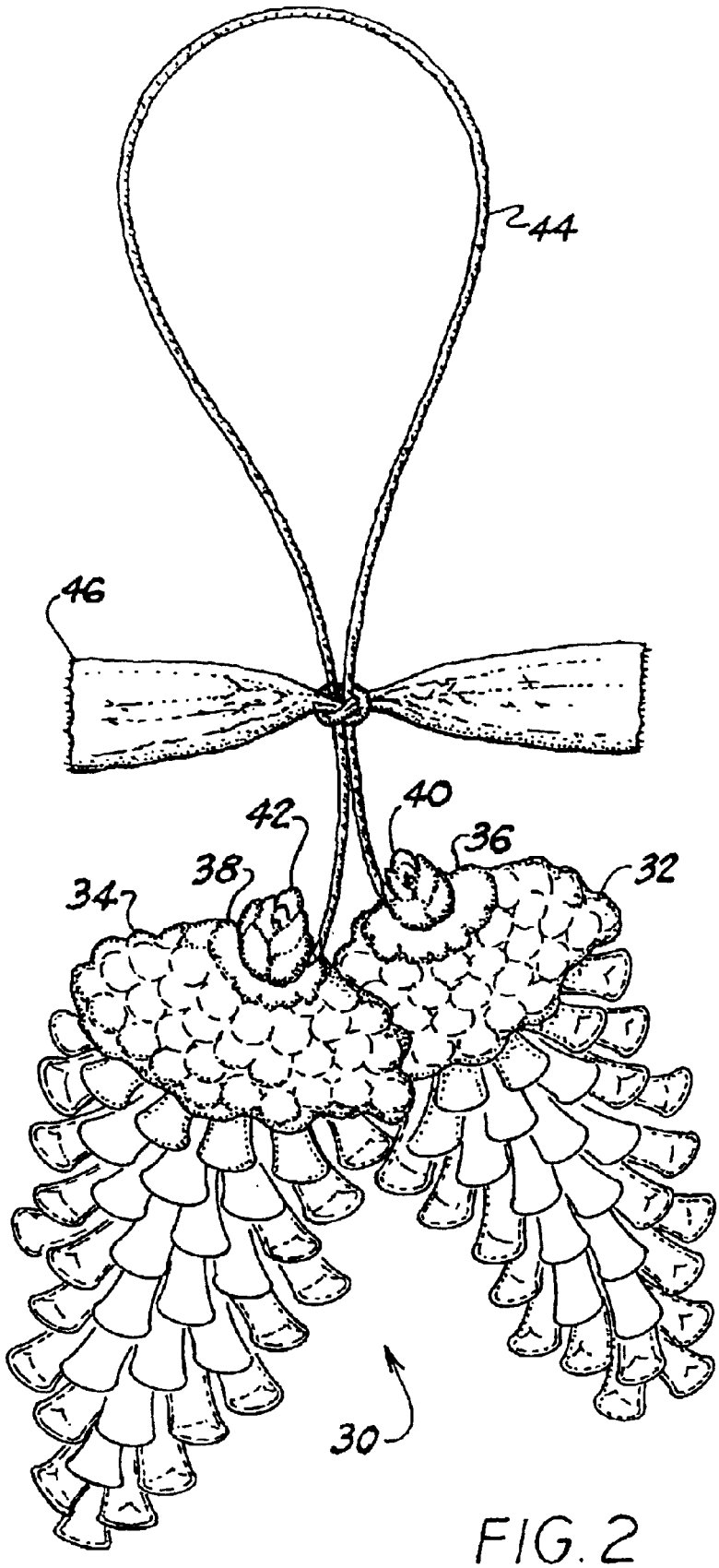
FIG. 2 is an elevational view of an embodiment of the invention structure.

FIG. 2 illustrates a pair of major pine cones 32 and 34 in side-by-side relationship. Each of the cones 32 and 34 presents a base end flat area identified as 36 and 38 for receiving sufficient glue to retain opposite ends of a cord 44 in position, each beneath the base of respective minor cones 40 and 42. The cones 32 and 34 are positioned by drawing them in close proximity to each other by the attachment of a ribbon 46 which is tied about the cord 44 as shown.

Figure 3:
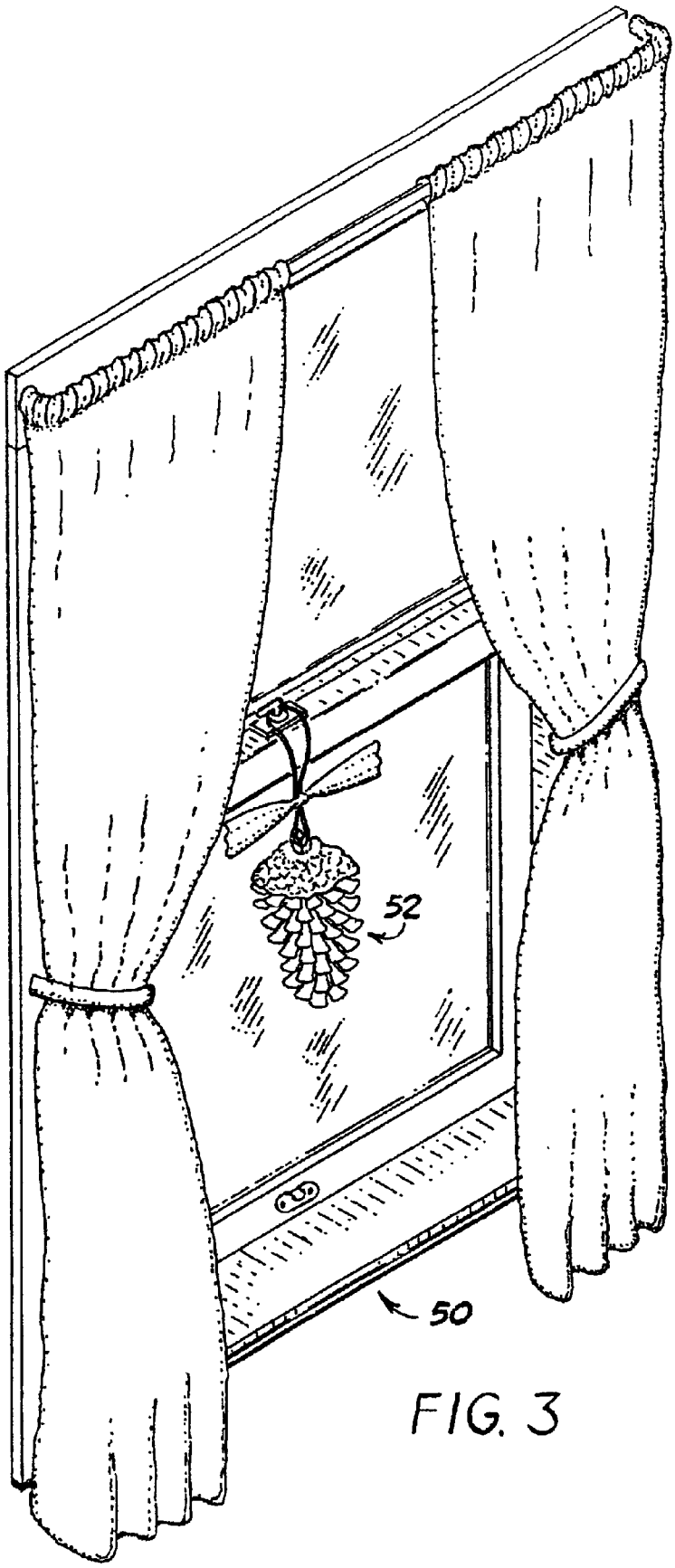
FIG. 3 is a perspective view which illustrates the structure of one form of the invention.

FIG. 3 illustrates a window frame 50 in obviously reduced scale, and the positioning therewith of a pine cone display 52 in accordance with the present invention.

Features and characteristics of the invention structure can be best appreciated by a consideration of the method of forming a pine cone display of the type herein disclosed. The major part of the pine cone display is a relatively large pine cone on which is placed, in the depression located centrally on the cone base, sufficient glue to create a firm bond as shown in FIG. 1. The opposite ends of a nine-inch-length jute twine are placed in the glue whereby the twine forms a generally circular cord loop. Then, a relatively small pine cone, preferably from either a Tamarack or Eastern Hemlock tree, is pressed with its base into the glue and over the two ends of the twine.

Any suitable container may be used to melt and liquefy sufficient beeswax to allow the assembly to be dipped into the wax to an extent that both pine cones are immersed and the cord loop, though partly immersed, may be used to withdraw the assembly from the liquefied wax and to then hang the assembly by the cord whereby excess wax can drip downwardly. In preparing the wax for the immersion step heretofore described, a scented oil is mixed with the wax, usually an ounce or more of the selected oil to each pound of wax. Commercially available color buds or dye chips may be added to the wax to attain a desired color. Beeswax varies in shades of yellow gold to light brown in accordance with the natural color imparted to the wax during the bee pollination process. Repeated warming of the beeswax bath results in the wax taking on a darker hue. Color buds or chips may be stirred into hot wax samples until a desirable pleasing color is attained.

Each pine cone assembly is preferably dipped three times in the liquefied wax, allowing the wax to cool and harden after each dipping step. With respect to the preferred embodiment of the invention structure shown in FIG. 2, an inch-wide strip of homespun fabric, about four and one-half inches long, may be utilized as a knotted ribbon to draw together two of the pine cone assemblies to form a display unit.

It is believed the most important step in the method of forming the invention structure is the addition of an appropriate selected scented oil into the liquefied beeswax whereby the scent will be gradually released from the wax in response to heating of the wax from the rays of the sun. Accordingly, the preferred embodiments of the invention are intended to be hung for display on a window frame as shown in FIG. 3 whereby exposure of the display assembly to the sun's radiant heat will cause the scent to be dispersed from the beeswax coating on the pine cones. A large selection of scented oils are commercially available for use in combination with the beeswax to provide attractive and pleasant aromatic effects. Distinctive scents, such as cinnamon or hot apple pie, are popular choices.

In view of the description herein of the presently preferred embodiments of the invention, it should be apparent that the pine cone display structure is suitable as a craft item that can be manufactured and displayed in various forms utilizing pre-selected contrasting colors in the beeswax coating, as well as any one of commercially available aromatic substances.

It is recognized that disclosure of the various embodiments of the invention hereinabove set forth will enable variations and modifications from the specific structures shown, with all such variations and modifications coming within the spirit and intent of the invention as defined in the appended claims.

What is claimed is:

1. A decorative pine cone display assembly comprising:

a first pine cone;

a second comparatively smaller pine cone corresponding generally in size to the central base area of the first pine cone;

bonding means for fixedly positioning the second cone to the central base of the first cone whereby the narrow ends of both cones are axially opposed to each other;

the first and second pine cones being coated with a layer of wax, further comprising a flexible cord looped between the cones and held by the bonding means.

2. The assembly of claim 1 wherein the coating on the first cone is beeswax.

3. The assembly of claim 1 wherein the coating on the first cone has at least one additional coat thereon.

4. The assembly of claim 1 further comprising an outer surface that exudes a distinctive aroma in reaction to its exposure to radiant heat energy.

5. A decorative pine cone display assembly having a pair of pine cone assemblies, each said pine cone assembly comprising:

a first pine cone;

a second comparatively smaller pine cone corresponding generally in size to the central base area of the first pine cone; and bonding means for fixedly positioning the second cone to the central base of the first cone whereby the narrow ends of both cones are axially opposed to each other, the first and second pine cones being coated with a layer of wax, further comprising a flexible cord looped between the cones and held by the bonding means.

6. The assembly of claim 5 wherein the coating on each first cone is beeswax.

7. The assembly of claim 5 wherein the coating on each first cone has at least one additional coat thereon.

8. The assembly of claim 5 further comprising an outer surface that exudes a distinctive aroma in reaction to its exposure to radiant heat energy.

9. The assembly claim 5 further comprising a ribbon tied about the flexible cord so that the two pine cone assemblies may be positioned in close proximity to each other.

* * * * *

UNITED STATES PATENT AND TRADEMARK OFFICE

CERTIFICATE OF CORRECTION

PATENT NO. : 6,913,800 B2
DATED : July 5, 2005
INVENTOR(S) : Rhonda L. Monks

It is certified that error appears in the above-identified patent and that said Letters Patent is hereby corrected as shown below:

Column 4,
Line 26, "assembly claim 5" should read -- assembly of claim 5 --.

Signed and Sealed this

Third Day of January, 2006

JON W. DUDAS
*Director of the United States Patent and Trademark Office*